US005743636A

United States Patent [19]

Payne

[11] Patent Number: 5,743,636

[45] Date of Patent: Apr. 28, 1998

[54] MIXING MAT FOR CONCRETE

[76] Inventor: Walter L. Payne, 47156 Kentwell Pl., Sterling, Va. 20165

[21] Appl. No.: 771,152

[22] Filed: Dec. 20, 1996

Related U.S. Application Data

[63] Continuation-in-part of Ser. No. 498,700, Jul. 3, 1995, abandoned.

[51] Int. Cl.[6] ..... B28C 5/00; B28C 5/44

[52] U.S. Cl. ..... 366/1; 366/3; 366/349; 366/129; 383/4

[58] Field of Search ..... 366/1, 3, 4, 349, 366/348, 347, 129; 383/4, 6

[56] References Cited

U.S. PATENT DOCUMENTS

| | | | |
|---|---|---|---|
| 699,589 | 5/1902 | Stoffel | 383/4 |
| 1,080,315 | 12/1913 | Allen | 383/4 |
| 1,629,723 | 5/1927 | Moler | 383/4 |
| 2,312,444 | 3/1943 | Rochford et al. | 366/349 |
| 2,908,020 | 10/1959 | Barton | 383/4 |
| 4,449,279 | 5/1984 | Takeuchi | 383/4 |
| 4,470,703 | 9/1984 | Nickerson, Jr. | 366/3 |
| 4,671,393 | 6/1987 | Rainey | 383/4 |
| 5,577,730 | 11/1996 | Vannozzi, Sr. | 383/4 |

*Primary Examiner*—Tony G. Soohoo
*Attorney, Agent, or Firm*—Roland H. Shubert

[57] ABSTRACT

Single bag quantities of blended cement and aggregate are mixed with water to form concrete using a flexible mat that is arranged with a shallow central basin bounded by a flat skirt. A plurality of handles, suitably four, are provided in the skirt near the mat edge. A sufficient amount of water to mix with a single bag or batch of pre-blended cement and aggregate is placed in the basin, and the batch amount of cement and aggregate is then poured onto the mat atop the water. Two persons grasp the mat by way of adjacent handles and mix the water with the cement and aggregate by alternately raising and lowering diagonally opposite mat handles.

14 Claims, 2 Drawing Sheets

MIXING MAT FOR CONCRETE

This is a continuation-in-part of application Ser. No. 08/498,700, filed on Jul. 3, 1995 now abandoned.

TECHNICAL FIELD

This invention relates to methods and means for mixing a blend of particulate and powdered solids with water and other liquids.

More particularly, this invention relates to a method and means for mixing a blend of a cementitious powder and particulate solids with water.

In a specific embodiment, this invention relates to methods and means for small-batch, hand mixing of a dry blend of cement and particulate solids with water to form a mortar or concrete.

BACKGROUND ART

It has become commonplace for hardware and building supply stores to sell dry compositions that can be mixed with water to form concretes and mortars. Those compositions are generally packaged in bags that are sized for convenience in handling and use. Some degree of standardization has evolved in the industry, and it is common for dry concrete and mortar compositions to be packaged in 40, 60 and 80-pound bags. An 80 pound bag of a dry blend of cement and aggregate when mixed with water will make about ⅔ of a cubic foot of concrete.

Packaged concrete and mortar compositions typically find use in small lobs where it is not practical to use premixed concrete. Typical of such small jobs are the setting of fence posts and the building of patios, walks, and the like. It is usual practice to mix one bag of the dry concrete or mortar mix at a time. Mixing is ordinarily accomplished by emptying a bag of the dry blend into a wheel barrow or mortar boat, adding water, and then agitating the mixture using a shovel or hoe until a plastic-like consistency is achieved. The resulting mixture is then poured or shoveled into a form or around a post. While such mixing methods are slow and physically difficult, those disadvantages are offset by the convenience and economies obtained.

With this background, it can be appreciated that devices which can ease the physical effort presently required to mix packaged concrete and mortar compositions, and speed the process as well, will be of considerable interest and importance to users of such compositions.

DISCLOSURE OF THE INVENTION

This invention provides a mat for batch mixing a blend of dry ingredients, typically cement and aggregate, with water. The mat comprises a generally planar sheet of flexible material, suitably of rectangular or ovoid shape, arranged with a central depression bounded by a flat border surface. The central depression serves as a reservoir for water that is mixed with the dry ingredients and is sized to hold a sufficient quantity of water to mix one batch. A plurality of handles, suitably four, are fashioned as apertures in the border surface near the mat perimeter. Mixing of a single batch is best accomplished by two people who each grip the mat by two adjacent handles and alternately raise opposite corners of the mat to repeatedly fold the ingredient blend, thereby mixing it with water. The mat is preferably packaged and stored as a roll inserted within a tubular, water-tight container that also serves to measure the amount of water needed to mix one standard batch.

Hence, it is an object of this invention to provide a method and means for batch mixing a blend of dry ingredients with water.

It is another object of this invention to batch mix a blend of cement and aggregate with water to form a mortar or concrete.

It is a specific object of this invention to provide a device and a method for mixing pre-packaged blends of cement and aggregate with water to form concrete.

Other objects and advantages of the invention will be apparent from the following detailed disclosure.

DESCRIPTION OF THE PREFERRED EMBODIMENTS

Figure 1:
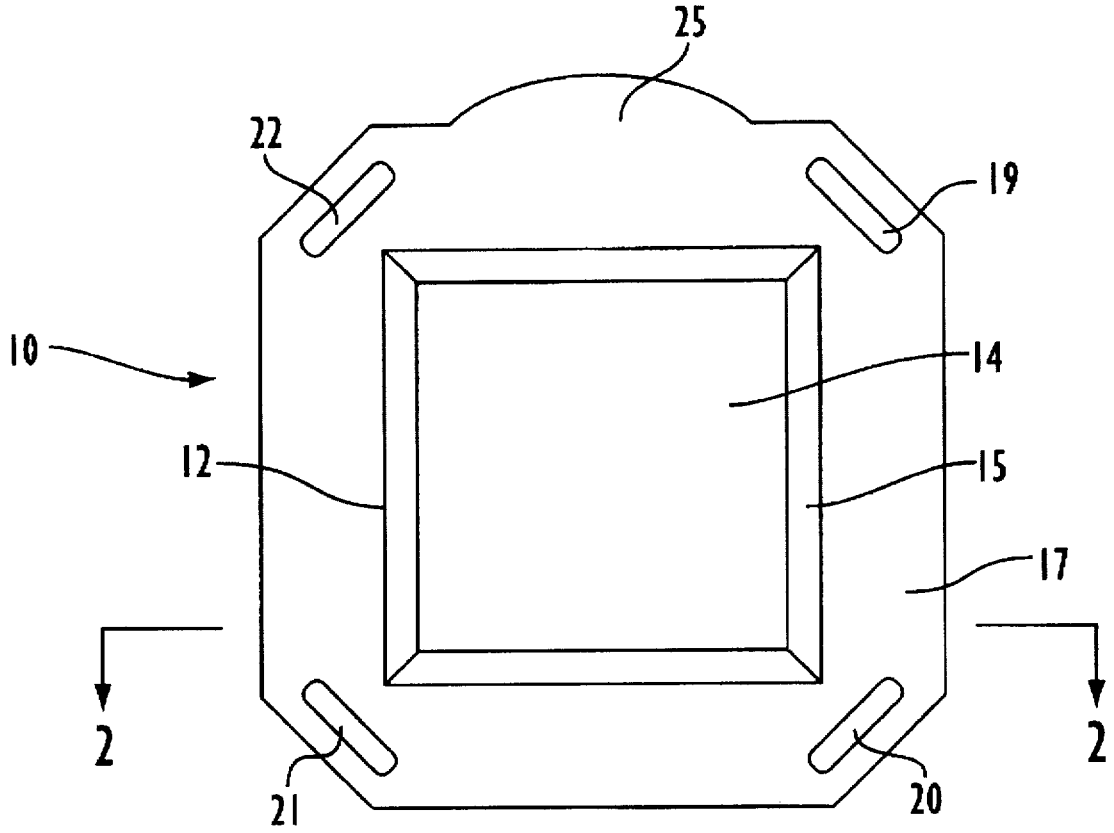
FIG. 1 is a plan view of the mixing mat of this invention.
Figure 2:
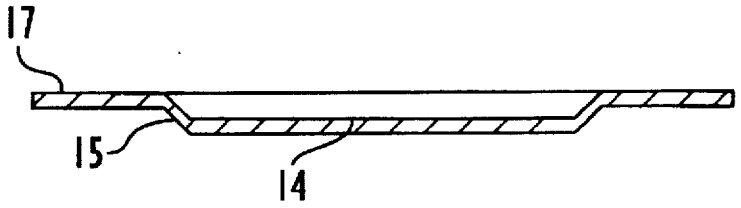
FIG. 2 is a sectional view taken along line 2—2 of FIG. 1.

This invention provides a mat for batch mixing a dry blend of cement and aggregate with water to form concrete or mortar. It is particularly useful for mixing, a bag at a time, the pre-packaged, dry concrete or mortar mixes that are commonly sold in 40, 60 or 80 pound bags. Referring first to FIGS. 1 and 2 of the drawings, the mixing mat 10 of this invention is shown in plan view. It conveniently may be of generally rectangular shape and is formed with a shallow, central basin 12 having a flat bottom 14 and sloping or vertical sides 15. Basin 12 functions as a reservoir for the water that is mixed with the dry ingredients and is sized such that it will hold at least as much water as is required to mix a single batch of concrete or mortar. Mat 10 is preferably arranged with basin 12 in the center with a flat skirt 17 extending between basin sides 15 and the mat edge. Skirt 17 provides an additional mixing surface to facilitate the merging of the dry cement and aggregate with water The basin may be symmetrical in shape with mat 10, as is shown in FIG. 1, or it may be circular or polygonal. A plurality of handles, 19, 20, 21, and 22, are provided near the mat edge. These handles may conveniently be fashioned as apertures in mat skirt 17 as is shown in the drawing. Although not necessary to the mixing function of mat 10, it is preferred to provide a pouring lip 25 on one side of mat 10 between two of the handles. Lip 25 aids in directing the mixed concrete or mortar into a form or other receptacle as it is poured from the mat.

Figure 3:
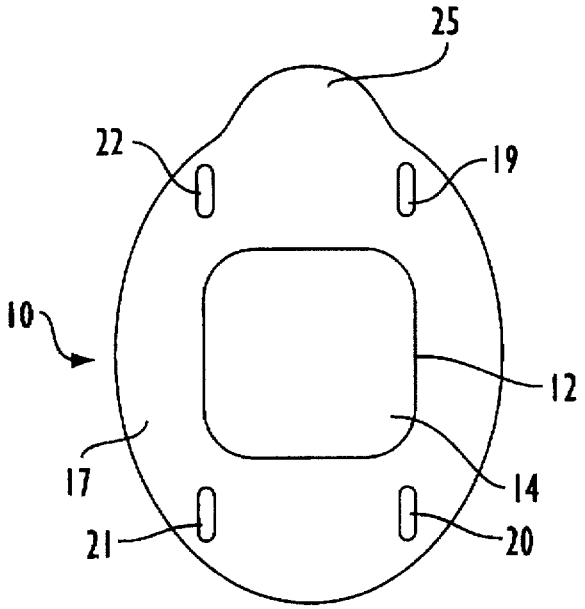
FIG. 3 depicts another embodiment of the mixing mat of FIG. 1.

FIG. 3 illustrates another embodiment of mixing mat 10 in which the mat is generally ovoid in shape. Basin 12 may be ovoid as well, or substantially rectangular in shape as is illustrated. No matter the shape, the volume of basin 12 must be great enough to hold a quantity of water sufficient to mix with a bag of pre-blended cement and aggregate. It is desirable that basin 12 be shallow, appropriately between ½ and 1½ inches in depth, as that contributes to mixing efficiency. The basin area is not critical so long as it provides enough volume to hold the water required. Basin area may range generally from about 20% to about 50% of the total mat area. As in the embodiment of FIG. 1, four handles, 19, 20, 21, and 22, are formed as elongated, hand-sized openings in skirt 17. A pouring lip 25 may also be provided between any two adjacent handle openings.

Mat 10 may be formed from a sheet of strong, flexible material such as rubber, fiber reinforced plastic or the like. It must be strong enough to support the weight of the material being mixed, as much as 100 pounds, without undue stretching, tearing or deforming, yet be flexible enough to allow a thorough mixing action to take place. Generally speaking, rubber or plastic sheeting material having a thickness greater than about 20 mils is suitable for use in fabricating the mat. The mat is sized such that the distance between adjacent handles is a comfortable arm-spread for the user. For most users, an appropriate distance between adjacent handles will be in the general range of about 2½ to 3½ feet. The overall dimensions of mat 10 necessarily are somewhat greater than is the handle spacing, and the length and width of mat 10 conveniently may range from about 3 to 4 feet.

Figure 4:
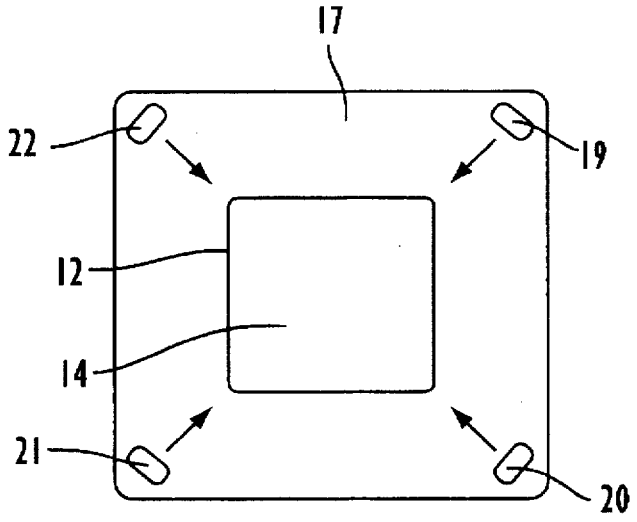
FIG. 4 is a diagrammatic representation of the mixing process used with the mat of FIGS. 1 or 3.

FIG. 4 is a diagrammatic representation of the mixing process as it is carried out using the mat of this invention. That Figure depicts mat 10 with central basin 12 and handles 19, 20, 21, and 22 arranged near the corners of the mat. A quantity of water sufficient to form the desired plastic-like consistency when mixed with a pre-blended bag of cement and aggregate is added to the central basin 12. The bag of cement and aggregate is then poured onto mat 10 atop the water. Two persons then pick up the mat, each grasping the mat through adjacent handle apertures. Assume that one person grasps the mat by means of handles 19 and 20 and the other person grasps the mat using handles 21 and 22. One of the handles, handle 19 for example, is raised to fold and pour the mixture toward the diagonally opposite corner handle 21. Handle 21 is in turn raised to fold the mixture back toward its original position. In a similar fashion, the other diagonally opposite handles are alternately raised to fold and re-fold the mixture. Several of those cycles are sufficient to thoroughly blend the water with the cement and aggregate to form a concrete of suitable consistency. The resulting concrete is then poured from the mat into a form or other repository. If the mat is provided with a pouring lip 25 (as is shown in FIGS. 1 and 3), the two persons using the mat position themselves so that the lip is between them.

Figure 5:
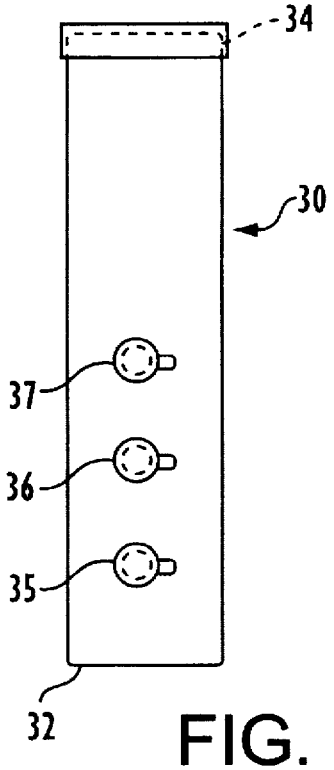
FIG. 5 shows a measuring and storing container for use with the mat of this invention.

In another preferred embodiment of this invention that is illustrated in FIG. 5, there is provided a dual-purpose storage receptacle 30 for mat 10. Receptacle 30 comprises an elongated container that may be polygonal in cross section, but preferably is shaped as a cylinder with a closed bottom end 32. Diameter of the container is set such that mat 10, when loosely rolled, will fit inside, and the container height is slightly greater than is the length of the rolled mat. A lid 34 is arranged to fit over the top of the container. The container itself is constructed to be watertight, and is arranged with indicia 35, 36 and 37. Those indicia show the proper amount of water to be added to a bag of pre-blended cement and aggregate in order to obtain the desired plastic-like consistency of the resulting concrete. As was stated before, it is common for dry concrete and mortar compositions to be packaged in 40, 60 and 80-pound bags. Therefore, indicia 35, 36 and 37 are set respectively to show the proper amount of water to be used with each of the three standard bag sizes.

Indicia 35, 36 and 37 each preferably comprise a stopper means that is arranged to close a hole through the side wall of cylinder 30. The lowermost stopper 35 is set at a level marking the amount of water to be mixed with the smallest, or 40-pound bag of pre-blended cement and aggregate and the topmost stopper 37 is set at a level marking the amount of water to be used with the largest bag. In use, water is added to container 30 to a level at or above the indicia. The stopper that represents the bag size being mixed is then removed, allowing water to drain from the container to the level of the stopper. For example, were an 80-pound bag of cement and aggregate to be used, then container 30 would be filled to a level at least as high, or above, stopper 37. That stopper would then be removed, allowing water to drain from container 30 until it reached the level of the hole through the container sidewall that had been closed by stopper 37. The water remaining in container 30 would then represent a precisely measured amount, just sufficient to mix with an 80-pound bag of cement and aggregate to obtain the desired consistency of the resulting concrete.

Those persons who have used bags of pre-blended cement and aggregate to mix small quantities of concrete will appreciate the advantages that this invention brings. Mixing the pre-blended cement and aggregate with water using the mat of this invention takes far less effort than is required by traditional techniques in which the mixing takes place in a wheel barrow or mortar boat. The precise measurement of the water that is used in mixing results in a more consistent and higher quality concrete. Pouring the mixed concrete into a form is facilitated by the pouring lip provided on one side of the mat.

While preferred embodiments of the invention have been presented for purposes of illustration and description, that disclosure is not intended to be exhaustive, nor to limit the invention to the precise forms disclosed. Other variations and modifications to the invention will be apparent to those skilled in the art after study of the foregoing disclosure.

The embodiments of the invention in which exclusive rights are asserted are set out in the following claims.

I claim:

1. A device for mixing a blend of dry ingredients with a liquid and for setting the ratio of the dry ingredients to the liquid, comprising:

a sheet of flexible material arranged to form a reservoir and a planar skirt, said reservoir positioned at a central area of said sheet and shaped as an open-topped basin having a flat bottom, said basin arranged and sized to hold a predetermined volume of liquid, said skirt surrounding said basin, disposed generally parallel with said basin bottom, spaced from the plane of said basin bottom by basin sides extending between the basin bottom and the skirt, and extending from the top of said basin sides to the perimeter of said sheet; and a plurality of handles disposed around the perimeter of said skirt.

2. The device of claim 1 in which the handles are four in number.

3. The device of claim 2 wherein said handles are positioned between about 2½ and 3½ feet apart.

4. The device of claim 1 wherein said sheet is generally rectangular in shape, wherein said blend of dry ingredients comprises cement and aggregate, and wherein said liquid is water.

5. The device of claim 4 wherein the area of said basin makes up more than 20% but less than 50% of the total sheet area, and wherein the depth of said basin is between ½ and 1½ inches.

6. The device of claim 1 wherein said planar skirt includes an outwardly extending pouring lip fashioned as an extension of said skirt, and positioned between two of said handles.

7. The device of claim 1 wherein said sheet is generally ovoid in shape, and wherein said basin is symmetrical in shape with said mat.

8. The device of claim 1 wherein said sheet is constructed of a material selected from the group consisting of rubber and plastic sheeting having a thickness greater than 20 mils.

9. The device of claim 1 wherein the length and width of said sheet are between 3 and 4 feet.

10. The device of claim 1 including an elongated container having a closed, water-tight, bottom end, said container adapted to stand upright on its bottom end and to hold and store said sheet when it is loosely rolled, said container arranged with indicia to show that level of water within said container that is required for mixing with a predetermined quantity of cement and aggregate to form concrete.

11. The device of claim 10 wherein said indicia comprise removable stopper means arranged to close or open a hole through the side wall of said container.

12. The device of claim 10 wherein said predetermined quantity of cement and aggregate ranges from 40 to 80 pounds.

13. A method for batch mixing a dry blend of cement and aggregate with water comprising:

providing a sheet of flexible material having a shallow, open-topped basin centrally located thereon, said basin arranged and sized to hold a predetermined volume of liquid, a planar skirt extending around the perimeter of said basin to the edge of said sheet, and a plurality of handles positioned on the skirt near the sheet edge;

placing sufficient water into said basin to mix with a single batch of said cement and aggregate blend;

pouring a batch amount of said cement and aggregate blend onto said sheet atop the water;

raising a first of said handles to cause said cement and aggregate blend and water to fold toward the sheet side opposite said handle;

lowering said first handle and raising a second handle on the opposite sheet side; and repeating said raising and lowering until said cement and aggregate blend is mixed with the water to form a concrete.

14. The method of claim 13 wherein said batch amount of cement and aggregate ranges from 40 to 80 pounds.

* * * * *